United States Patent [19]

Opprecht

[11] 4,354,086

[45] Oct. 12, 1982

[54] AUTOMATED CAN RESISTANCE WELDER

[76] Inventor: Paul Opprecht, Im hinteren Bernold, 8962 Bergdietikon, Switzerland

[21] Appl. No.: 89,209

[22] Filed: Oct. 29, 1979

Related U.S. Application Data

[63] Continuation of Ser. No. 905,477, May 12, 1978, abandoned.

[30] Foreign Application Priority Data

Jun. 10, 1977 [CH] Switzerland ..... 7143/77

[51] Int. Cl.[3] ..... B23K 11/16

[52] U.S. Cl. ..... 219/64; 198/461; 198/577; 219/79

[58] Field of Search ..... 219/64, 79; 198/461, 198/577, 575, 579

[56] References Cited

U.S. PATENT DOCUMENTS

| | | | |
|---|---|---|---|
| 722,937 | 3/1903 | Begg | 198/579 |
| 814,442 | 3/1906 | Graham | 198/461 X |
| 2,203,403 | 6/1940 | Cameron . | |
| 3,713,862 | 1/1973 | Winkless . | |
| 3,745,295 | 7/1973 | Opprecht | 219/64 |

*Primary Examiner*—Elliot A. Goldberg
*Attorney, Agent, or Firm*—Werner W. Kleeman

[57] ABSTRACT

A transport installation and method of transporting can bodies for a fully automated resistance welding machine comprising a roll former station for rolling the bodies, two successively arranged driven transport systems, and a pair of welding electrodes. The transport systems comprise endless, revolving chains equipped with fixed catches or cams and defining first and second chains. The first chain passes through the roll former station where, during rolling of the blanks into the can bodies, it cyclically and periodically remains at least approximately stationary, whereas the second chain has a sinusoidal velocity course. The can bodies exposed to the intermittent non-continuous mode of operation of the first chain, necessitated by the roll forming operation, are transferred to the second chain and experience a movement which is stabilizing for the can bodies.

21 Claims, 7 Drawing Figures

AUTOMATED CAN RESISTANCE WELDER

CROSS-REFERENCE TO RELATED CASE

This is a continuation application of my copending U.S. application Ser. No. 905,477 filed May 12, 1978, now abandoned.

BACKGROUND OF THE INVENTION

The present invention relates to a new and improved construction of transport installation and method of transporting can bodies for a fully automated resistance welding machine, which is of the type comprising a roll former station for rolling the blanks into bodies, two successively arranged driven transport systems, and a pair of electrode welding rolls or rollers.

In German Patent Publication No. 2,103,551 there is taught to the art a transport installation for can bodies wherein rolled blanks, formed into can bodies, are moved out of a roll former station by means of a continuously driven transport chain equipped with fixed catches or cams up to the region of the electrode rolls and at that location are entrained by a pawl feed and through the remaining quite short path are brought up to the welding speed and then introduced into the welding station.

Such equipment is extremely suitable for the transport of up to 300 can bodies per minute. However, at greater production capacity there arise difficulties, because at the higher chain velocity there is not sufficient time available for the rolling of the blanks between two successive catches or cams.

SUMMARY OF THE INVENTION

Hence, with the foregoing in mind, it is a primary object of the present invention to provide an improved construction of transport installation and method of transporting can bodies for a fully automated resistance welding machine which is not associated with the aforementioned drawbacks and limitations of the prior art proposals.

Another and more specific object of the present invention aims at providing a new and improved construction of transport installation and method of transporting can bodies which is capable of handling production capacities exceeding 300 can bodies per minute, without the can bodies becoming damaged during the transport thereof by high velocity changes of the transport system.

Yet a further significant object of the present invention aims at maintaining small the mass forces in the transport system brought about by the velocity fluctuations or changes.

A further significant object of the present invention is to provide a transport installation for can bodies for resistance welding machines, which transport installation is relatively simple in construction and design, relatively economical to manufacture, extremely reliable in operation, provides for high production capacities, is not readily subject to breakdown or malfunction and requires a minimum of maintenance and servicing.

A further important object of the invention is directed to a novel method of transporting can bodies or the like in a resistance welding machine, wherein movement of the can bodies is controlled such that high speed transfer is possible through controlled selective movement characteristics imparted to the can bodies along different portions of the path of travel between the roll former station and the welding electrodes.

Now in order to implement these and still further objects of the invention, which will become more readily apparent as the description proceeds, the transport systems of the present development comprise endless revolving chains equipped with fixed catches or cams, the first chain passes through the roll former station where the blanks are rolled into can bodies and at which during such rolling operations the first chain cyclically and periodically comes at least approximately to standstill. The second chain has a sinusoidal velocity course, so that the intermittent, non-continuous mode of operation of the first chain, necessitated by the rounding of the blanks into the can bodies, is transformed at the second chain into a sinusoidal movement which is quieting for the bodies and with minimum velocity and changes in velocity.

Generally speaking, the method of transporting the rolled cans from the roll former station to the welding electrodes comprises providing two transport systems respectively having a first can body transfer device and a second can body transfer device. During rolling of the blanks into the can bodies the first can body transfer device is moved cyclically and periodically so that it remains at least approximately stationary in order to effectuate engagement of a rolled can body at the roll former station, whereas there is imparted to the second can body transfer device a sinusoidal movement having a velocity course such that the can bodies are transferred in a smooth fashion from the first can body transfer device when it is at least approximately at standstill or in the region of its lowest velocity course, to the second can body transfer device, whereafter the engaged can bodies are then moved at a greater velocity towards the welding electrodes for engagement thereby and performance of the welding operation at the requisite welding speed.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figure 1:
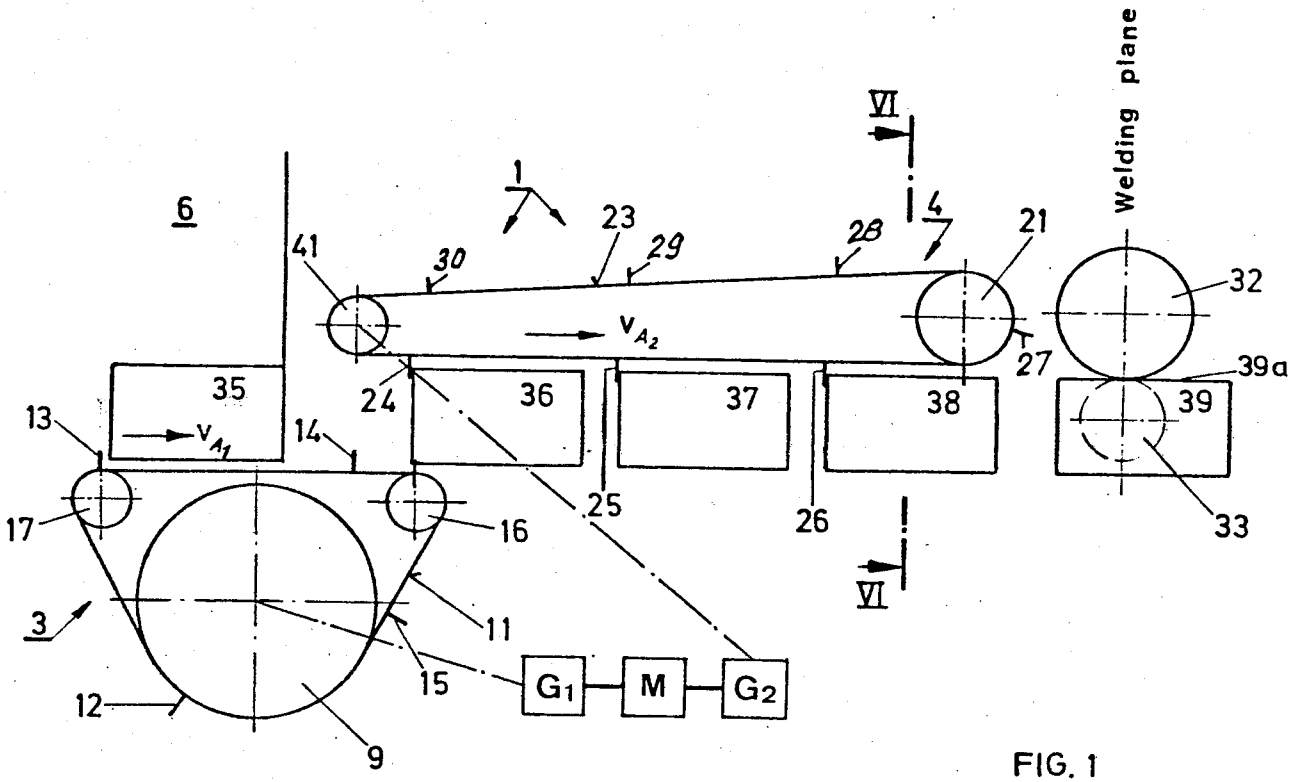
FIGS. 1 to 5 schematically illustrate in side view a transport installation constructed according to the teachings of the present invention and respectively showing five successive transport phases during the operation of such transport installation.

Describing now the drawings, in FIG. 1 there is illustrated an exemplary embodiment of transport installation 1 constructed according to the teachings of the present invention, which is of the type comprising a first transport device 3 shown in the form of an endless chain 11 and a second transport device 4 shown in the form of an endless chain 23. The first transport device 3 passes through a roll former apparatus or station 6. The roller former station 6, as is well known in the art, constitutes one of the processing stations of the automated resistance welding machine, and serves to roll the blanks into the can bodies. Details of the roll former station 6 are unnecessary for understanding the principles of the present invention, and it is to be understood that any suitable roll former station 6 capable of carrying out the contemplated function described above can be used. Continuing, the transport devices 3 and 4 are driven by any suitable common drive motor M. More specifically, the common drive motor M will be seen to drive two separate cam drive gears or gearing means $G_1$ and $G_2$, wherein the cam drive gearing $G_1$ drives the first transport device 3 and the cam drive gearing $G_2$ the second transport device 4. The cam drive gears or gearing drives $G_1$ and $G_2$ are commercially available cam drives, for instance of the type manufactured by Ferguson Machine Company, 11820 Lackland Rd., St. Louis. Mo., and known as Ferguson Indexing Drives. These cam drive Gears $G_1$ and $G_2$ impart the desired motion to the first and second transport drives or systems 3 and 4, respectively, as will be explained more fully hereinafter. In particular, a sprocket wheel or gear 9 is driven by the cam drive gearing $G_1$ in order to impart to the first transport device or transport system 3 a desired sinusoidal-like motion, to be discussed more fully hereinafter in conjunction with FIG. 7, and the chain 11 of such transport device 3 is moved so as to have a sinsuoidal velocity course where, when the chain 11 moves through the roll former station 6, during rolling of the blanks into the can bodies, it cyclically and periodically remains at least approximately stationary. The chain 11 has four fixed catches, here in the form of four entrainment members 12, 13, 14 and 15, although obviously a different number of such entrainment members can be used depending upon the system design. The chain 11 is guided about two deflection sprocket wheels or gears 16 and 17.

Continuing, the second transport device or transport system 4, which follows the first transport device or system 3, is driven, as mentioned, by the same drive motor M through the agency of the cam drive gearing or gearing drive $G_2$ which acts upon the sprocket wheel or gear 41. Trained about this sprocket wheel or gear 41 is the chain 23 having the catches or cams, here shown as entrainment members 24, 25, 26, 27, 28, 29 and 30, and again a different number of such entrainment members is usable depending upon the system design. The chain 23 is guided over a further deflection sprocket wheel or gear 21. The spacing of the entrainment members 24 to 30 along the chain 23 is smaller in the case of the transport system 4 than for the transport system 3, and specifically by a factor of 0.5 to 1.0, preferably 0.8. Following the transport device or system 4 are electrode welding rolls or rollers 32 and 33 of the electrode welding station.

Now in FIGS. 1 to 5 there have been conveniently shown five sheet metal bodies 35, 36, 37, 38 and 39. FIG. 1 illustrates the start of an infeed and transport cycle of the can body processing operations. The rolled blank forming a can body 35 which has just been rolled into such rounded can body, is located directly before the start of its transport by the entrainment member 13 of the transport system 3. This phase of operation corresponds to point $A_1$ in the diagram of FIG. 7.

The second can body 36 is moved by the entrainment member 24 of the second transport system 4 at approximately the maximum velocity in the direction of the welding rolls 32 and 33. This operation corresponds to the point $A_2$ of the diagram of FIG. 7

The next can bodies 37 and 38 are moved by two further entrainment members 25 and 26, whereas the can body 39 is located at the welding station containing the welding rolls or rollers 32 and 33.

Figure 2:
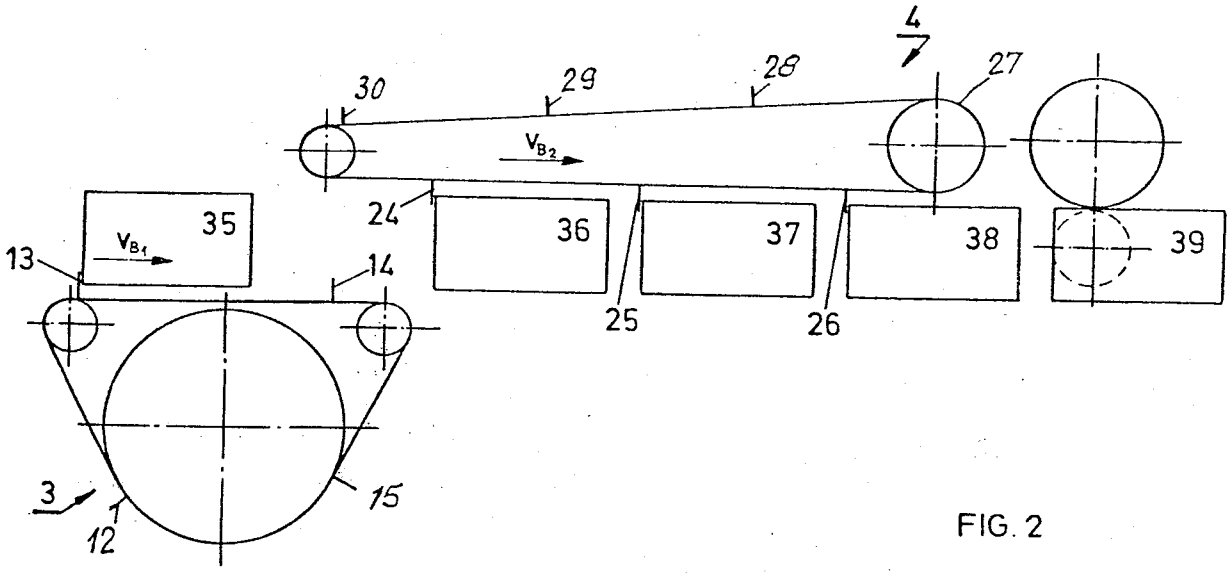

Now according to the showing of FIG. 2 the entrainment member 13 has just engaged the can body 35 at the roll former station 6. This operation corresponds to point $B_1$ of the graph 55 shown in the diagram of FIG. 7. The welding of the can body 39 proceeds in a direction opposite to its end 39*a*.

Figure 3:
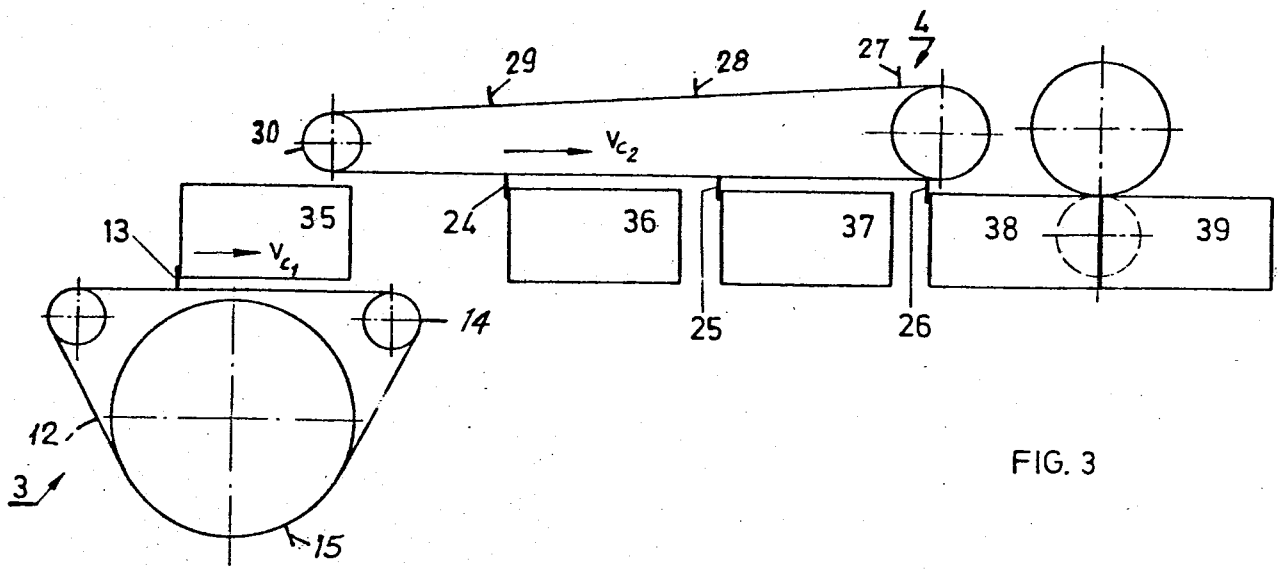

Turning attention now to FIG. 3, the transport system 3 is at the phase of maximum velocity. This corresponds to the point $C_1$ of the graph 55 of FIG. 7. The transport system 4 is just in the process of displacing the rolled can body 38 between the welding rolls 32 and 33, this being accomplished at the welding speed. Such corresponds to the point $C_2$ of the graph 57 of FIG. 7. The spacing of the blanks 38 and 39 is greater than zero, but approximately equal to zero. The velocity at the point $C_2$ amounts to between about 20 and 80 m/min.

Figure 4:
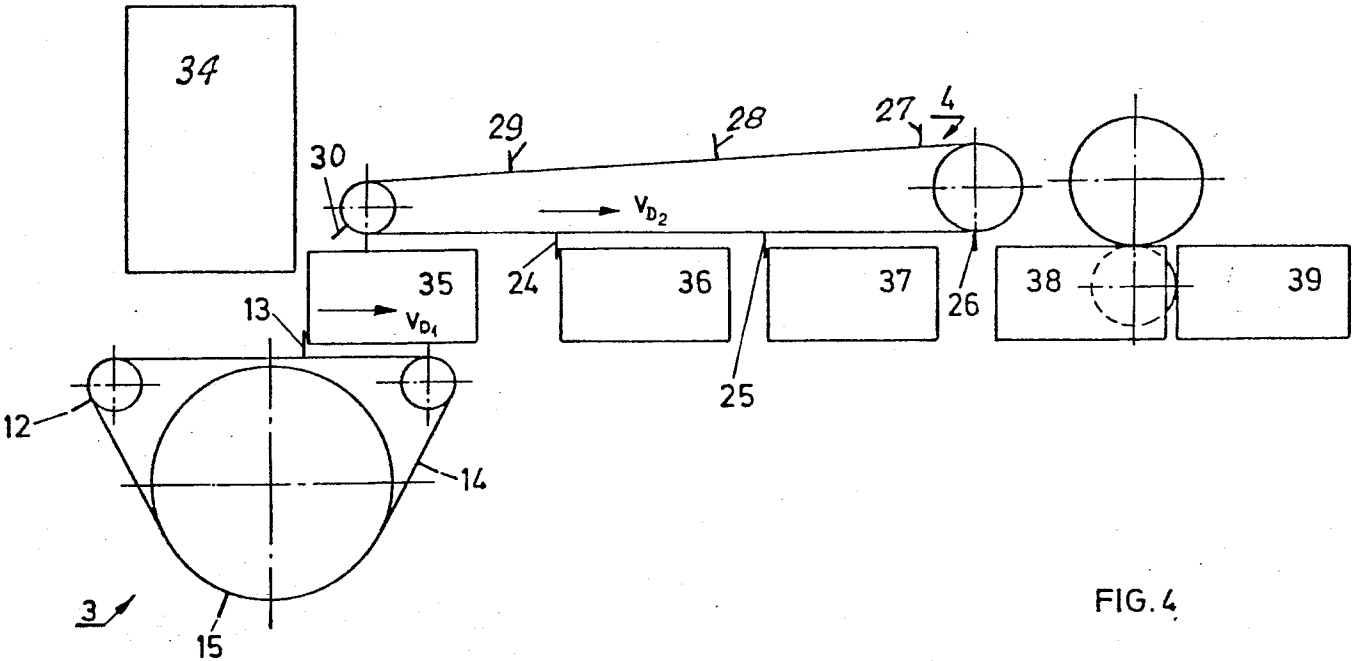
Figure 5:
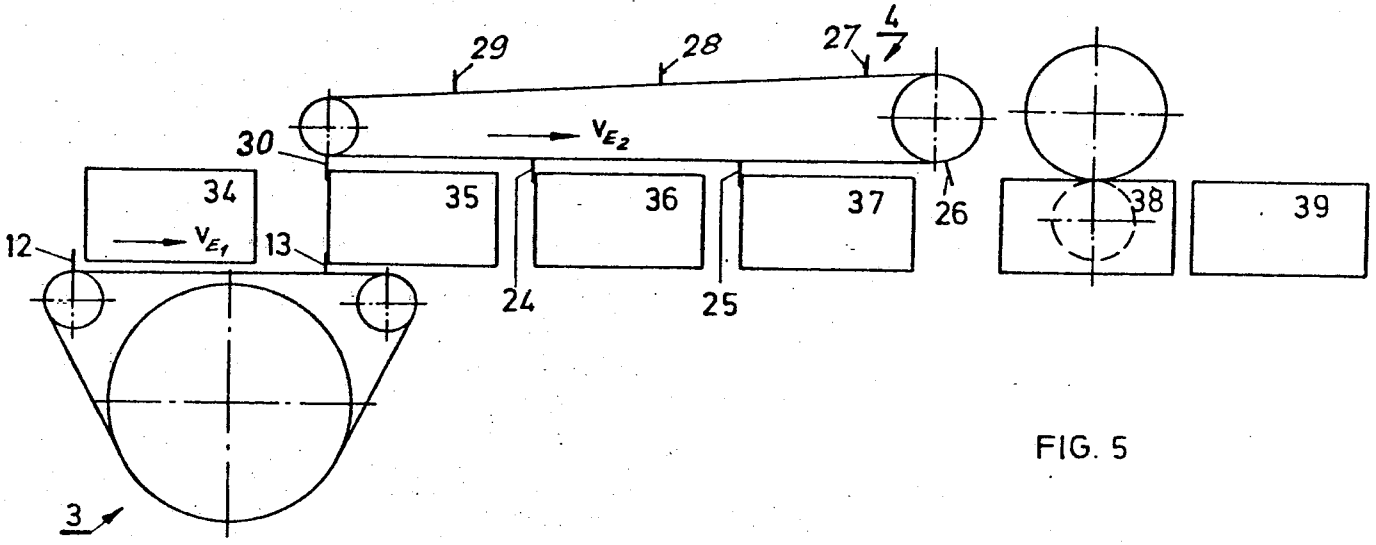

In FIG. 4 both of the transport systems 3 and 4 have been shown in their retardation or deceleration phase. Such corresponds to points $D_1$ and $D_2$ of the graphs 55 and 57 of FIG. 7. The rolling of the next blank 34 has begun. In FIG. 5 the transport system or device 3 is stationary. This corresponds to point $E_1$ of the graph 55 of FIG. 7. There now has begun the transfer to the transport system 4. This transport system 4 engages the can body 35. This corresponds to point $E_2$ of the graph 57 of FIG. 7. After completion of the rolling operation at the blank 34 there is started the next cycle. This corresponds to the points $A_1$ and $A_2$ of the graphs 55 and 57 of FIG. 7.

Figure 6:
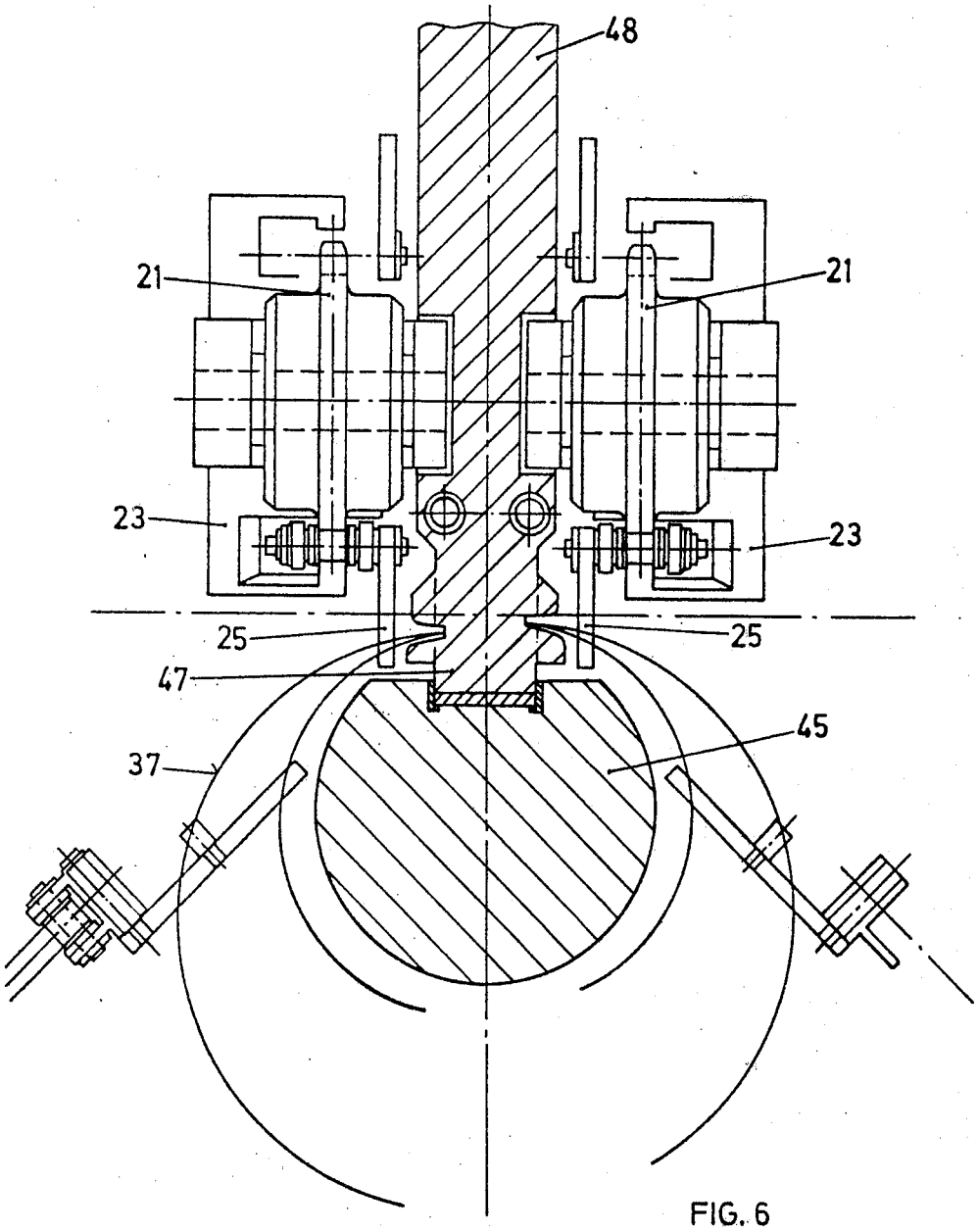
FIG. 6 is a cross-sectional view of the transport installation shown in FIG. 1, taken substantially along the line V1—V1 thereof.

In FIG. 6 there is visible a lower arm 45 as well as Z-shaped rail 47 attached to a support or carrier 48. It will be seen furthermore that the transport system or device 4 is constructed in the form of a double chain-transport device wherein each of the chains 23 are trained about a related sprocket wheel or gear 21 arranged at opposite sides of the support carrier 48. There is further shown how the entrainment members, here the entrainment members 25 at each such chain 23 engage at the rolled body 37 in order to urge such in the direction of the welding station and between the welding rolls 32 and 33.

Reverting again to FIG. 7, there are illustrated therein, as previously explained, the different velocity courses or curves as a function of time. Thus the curve 55 constitutes the velocity curve of the first transport system or device 3 and the curve 57 of the velocity curve of the second transport device or system 4. The curve 55, while being periodic, however is asymmetrical in its configuration, in that during a time amounting to about one-half to about one-tenth of the total cycle time (depending upon the diameter of the roll bodies) the velocity of the transport system 3 practically drops to the value zero. It is during this time when the sheet metal sections of the blanks are rolled into the rolled can bodies. In contrast thereto, the velocity curve 57 is practically devoid of any standstill time. It corresponds approximately to a sinusoidal curve. Its deceleration flank is longer in time than the acceleration flank, i.e. such is steeper.

Figure 7:
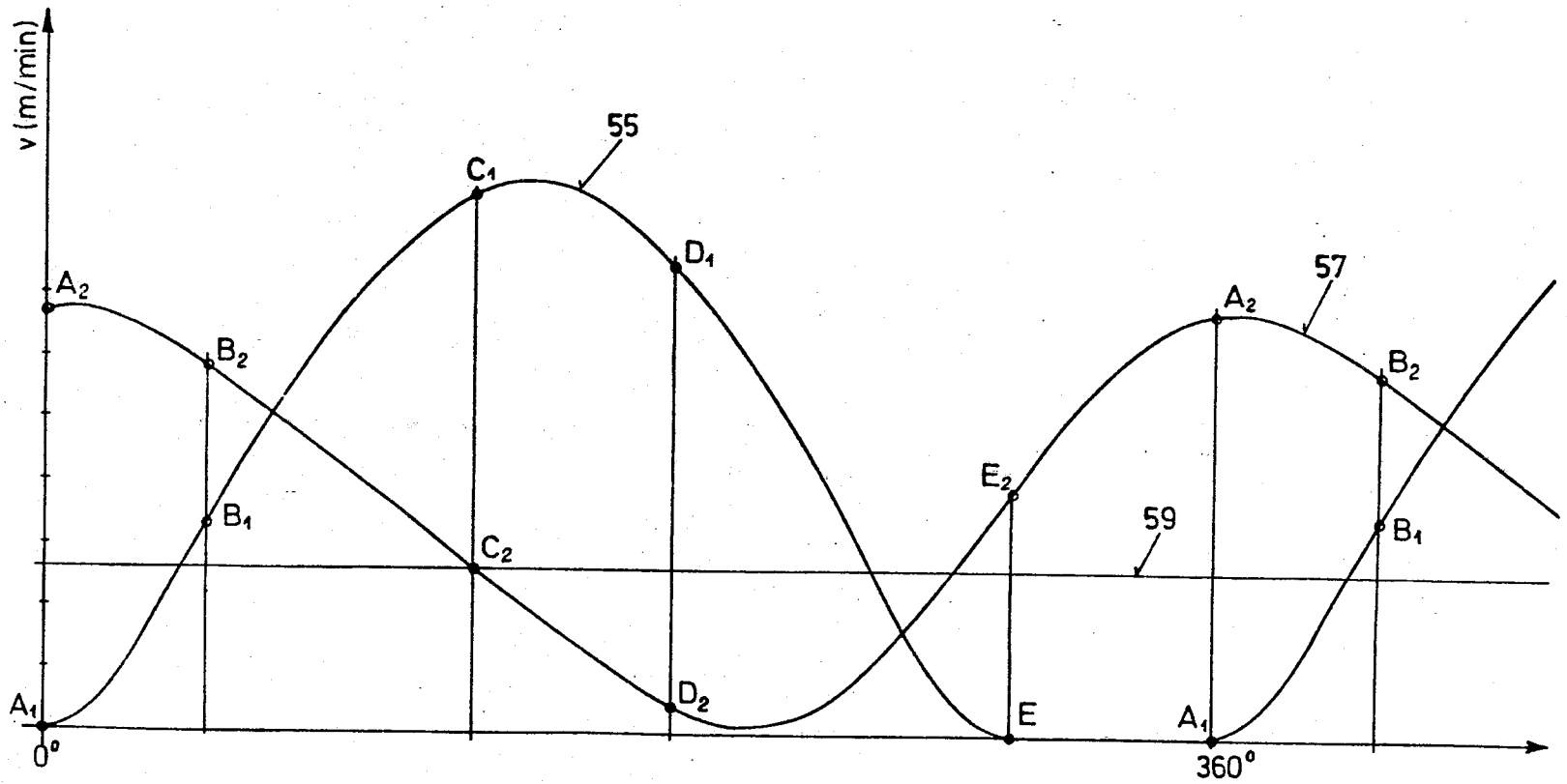
FIG. 7 are velocity graphs for the two transport systems and the welding electrodes as a function of time.

Additionally, the diagram of FIG. 7 further shows the welding curve 59 which is a straight line, since the welding speed remains essentially constant. The phase shift of the transport systems amounts to about 200°. The ratio between their maximum velocities amounts to 1.0 to 2.0, preferably 1.3. The maximum transport velocity of the first transport system 3 is greater than that of the second transport system 4. It amounts to 160 to 200 m/min, preferably to about 180 m/min.

The velocity curves 55 to 57 are selected such that the resultant acceleration and deceleration values are as low as possible, while maintaining further marginal conditions. A further condition resides in that the can spacing beneath the welding rolls 32 and 33 is essentially uniform and amounts to about 0.2 to 1 millimeter.

The rounded bodies, which are still somewhat open through a spacing of about 10 to 15 millimeters in the roll former station 6, are thereafter guided over the lower arm 45 and then continuously closed by means of conventional calibration tools, as is well known in this art, so that the edges of the can bodies which are to be welded, depending upon the prevailing requirements, reach the welding rolls or rollers 32 and 33 with a small overlap. The can bodies to be welded, even with extremely high production numbers, must be moved with as small as possible velocity, acceleration and deceleration through the transport system 4. Furthermore, the movement of the transport system 4 is designed such that the can bodies, following transfer to the welding rolls or rollers 32 and 33, are not damaged by the further moving entrainment members 24 to 30 which are turned or deflected at the sprocket gear or wheel 21.

The described transport installation must be capable of accomplishing the explained functions in a continuous operation free of any disturbances and without damaging the can bodies, and the output of such installation can amount to approximately 400 can bodies per minute and more.

By optimizing the course of the movement or the motion of both transport devices 3 and 4 in accordance with the velocity curves 55 and 57, it is possible, notwithstanding the high production velocities, to obtain minimum body velocities, acceleration and deceleration. This has a particularly advantageous effect in ensuring for undisturbed course of the movement of the transport installation and the processing of the can bodies therethrough.

While there are shown and described present preferred embodiments of the invention, it is to be distinctly understood that the invention is not limited thereto, but may be otherwise variously embodied and practised within the scope of the following claims. Accordingly,

What I claim is:

1. A can body automated resistance welding machine, comprising:

means defining a roll former station for rolling blanks into can bodies moving in a predetermined direction of travel;

means defining a welding station including a pair of welding electrode rolls arranged downstream with regard to the direction of travel of the can bodies for welding the rolled can bodies;

two successively arranged driven transport systems defining first and second transport systems;

each of said transport systems comprising at least one endless revolving chain equipped with spaced entrainment members for engagement of the can bodies, the chain of the first transport system defining a first chain and the chain of the second transport system defining a second chain;

means mounting said first chain so as to pass through the roll former station;

first driving means for driving said first chain at a varying velocity represented by a first cyclic velocity curve such that said first chain periodically remains at least approximately stationary with a substantially zero velocity; and second driving means for driving said second chain at a substantially sinusoidal velocity represented by a second, substantially sinusoidal velocity curve, said first and second velocity curves having a predetermined phase relationship whereby the rolled can bodies are transferred from the first chain to the second chain and experience a movement which is stabilizing for the can bodies.

2. The can body automated resistance welding machine as defined in claim 1, wherein:

said second transport system has an acceleration time and a deceleration time; and said acceleration time being shorter than said deceleration time.

3. The can body automated resistance welding machine as defined in claim 1, wherein:

the phase relationship between said velocity curves is about 200°.

4. The can body automated resistance welding machine as defined in claim 1, wherein:

said first and second velocity curves are mutually shifted in relationship to one another and have a ratio of the maximum value of their velocities between 1.0 and 2.0.

5. The can body automated resistance welding machine as defined in claim 4, wherein:

said ratio amounts to approximately 1.3.

6. The can body automated resistance welding machine as defined in claim 4, wherein:

the first driving means has a higher maximum velocity than the second driving means.

7. The can body automated resistance welding machine as defined in claim 6, wherein:

said higher maximum velocity amounts to between about 160 m/min and 200 m/min.

8. The can body automated resistance welding machine as defined in claim 7, wherein:

said maximum velocity amounts to approximately 180 m/min with a production of approximately 400 cans per minute.

9. The can body automated resistance welding machine as defined in claim 1, further including:

adjustment means which, during transfer of a can body from the first transport system to the second transport system enables adjusting the velocity of the first driving means to approximately zero and the velocity of the second driving means to a range between about 20 m/min to 100 m/min.

10. The can body automated resistance welding machine as defined in claim 1, further including:

adjustment means in order to enable transfer of the can bodies with decreasing velocity of the second driving means to the welding rolls at a velocity of about 20 m/min to 80 m/min, depending upon the required welding speed.

11. The can body automated resistance welding machine as defined in claim 1, wherein:

said adjustment means allows for an adjustment at approximately the same velocity of the second driving means and the welding rolls.

12. The can body automated resistance welding machine as defined in claim 1, wherein:

said first driving means has a velocity of approximately zero during the rolling operation of the blanks into can bodies for about one-half to one-tenth of the first cyclic velocity curve.

13. The can body automated resistance welding machine as defined in claim 1, further including:

means for mechanically interconnecting both of the transport systems with one another.

14. The can body automated resistance welding machine as defined in claim 1, wherein:

the spacing of the entrainment members of the second transport system is smaller than the spacing of the entrainment members of the first transport system.

15. The can body automated resistance welding machine as defined in claim 14, wherein:

said spacing of the entrainment members of the second transport system is smaller than the spacing of the entrainment members of the first transport system by a factor of 0.5 to 0.1.

16. The can body automated resistance welding machine as defined in claim 15, wherein:

said factor amounts to about 0.8.

17. The can body automated resistance welding machine as defined in claim 1, wherein:

said first and second velocity curves are selected such that the spacing between two successive can bodies in front of a welding plane defined by the welding rolls amounts to at most 1 millimeter.

18. The can body automated resistance welding machine as defined in claim 17, wherein:

said spacing is greater than zero.

19. The can body automated resistance welding machine as defined in claim 17, wherein:

said spacing amounts to approximately 0.2 millimeters.

20. A can body automated resistance welding machine, comprising:

means defining a roll former station for rolling blanks into can bodies moving in a predetermined direction of travel;

means defining a welding station including a pair of welding electrode rolls arranged downstream with regard to the direction of travel of the can bodies for welding the rolled can bodies;

two successively arranged driven transport systems defining first and second transport systems;

each of said transport systems comprising at least one endless revolving chain equipped with spaced entrainment members for engagement of the can bodies, the chains of the first and second transport systems defining first and second chains, respectively;

means mounting said first chain so as to pass through the roll former station;

first driving means for driving said first chain at a velocity which varies over a cycle from 0° to 360° commencing with an acceleration to maximum velocity then deceleration to a substantially zero velocity at substantially zero acceleration and deceleration for a portion of said cycle;

means for mounting said second chain adjacent the welding station; and second driving means for driving said second chain at a substantially sinusoidal velocity over said 360° cycle.

21. The can body automated resistance welding machine as defined in claim 20, wherein the second driving means has an accelerating and a decelerating velocity over said 360° cycle, said decelerating velocity occurring over a greater portion of said 360° cycle.

* * * * *